US005114680A

United States Patent [19]

Obermiller et al.

[11] Patent Number: 5,114,680

[45] Date of Patent: May 19, 1992

[54] FLOATABLE LABORATORY TUBE HOLDER

[75] Inventors: Patrice S. Obermiller, San Diego; Kirsten K. Blumeyer, Encinitas, both of Calif.

[73] Assignee: La Jolla Biological Laboratories, San Diego, Calif.

[21] Appl. No.: 416,045

[22] Filed: Oct. 2, 1989

[51] Int. Cl.[5] ..... B01L 9/06

[52] U.S. Cl. ..... 422/104; 422/99; 211/74; 211/80; 211/82

[58] Field of Search ..... 422/104, 99, 297, 300; 211/74, 71, 80–82

[56] References Cited

U.S. PATENT DOCUMENTS

| | | | |
|---|---|---|---|
| 1,653,244 | 12/1927 | White . | |
| 2,107,744 | 2/1938 | Solomon | 65/53 |
| 2,532,604 | 12/1950 | Carski | 211/74 |
| 3,483,997 | 12/1969 | Ritter | 211/76 |
| 3,649,462 | 3/1972 | Jessup | 422/104 X |
| 4,040,234 | 8/1977 | Stockdale et al. | 53/38 |
| 4,163,495 | 8/1979 | Drader | 206/506 |
| 4,195,734 | 4/1980 | Boner et al. | 206/558 |
| 4,281,768 | 8/1981 | Sommers | 211/74 |
| 4,284,603 | 8/1981 | Korom | 422/101 |
| 4,349,109 | 9/1982 | Scordato et al. | 206/562 |
| 4,389,374 | 6/1983 | Sutton et al. | 422/104 |
| 4,534,465 | 8/1985 | Rothermel et al. | 422/104 X |
| 4,599,314 | 7/1986 | Shami | 435/287 |
| 4,609,237 | 9/1986 | Daenen et al. | 312/351 |
| 4,921,676 | 5/1990 | Otani | 422/100 |
| 4,944,924 | 7/1990 | Mawhirt et al. | 211/74 X |

OTHER PUBLICATIONS

"Plasticware from Cole-Palmer", Cole-Palmer Instrument Company, Chicago, Ill., p. 63, 1987–1988.

Blumberg, "Guide to Molecular Cloning Techniques," *Methods in Enzymology*, 152, p. 18, Academic Press, Inc. (1987).

*Primary Examiner*—Lynn M. Kummert

*Attorney, Agent, or Firm*—Fitch, Even, Tabin & Flannery

[57] ABSTRACT

Laboratory tube, particularly centrifuge tube holders which float in water and have end members which can be pivoted between a substantially vertical lower position and a substantially vertical upper position in about 90 degree increments. In their lower position, the members serve as legs, while in an intermediate position, storage is facilitated. When in the upper position, the end members serve as handles and may be designed to lock in place an insert that prevents lids of the centrifuge tubes from inadvertently opening.

9 Claims, 1 Drawing Sheet

FIG.1
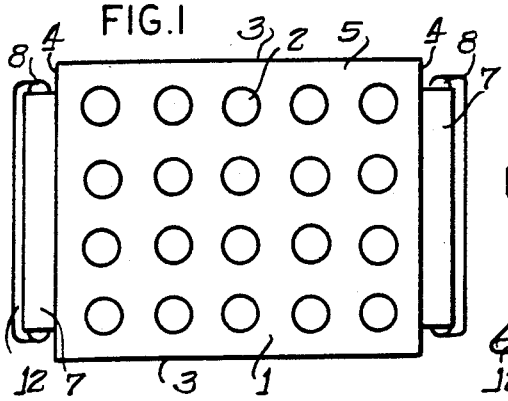
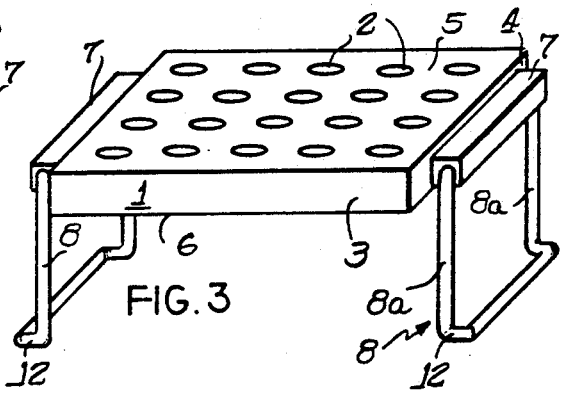
FIG.3
FIG.2
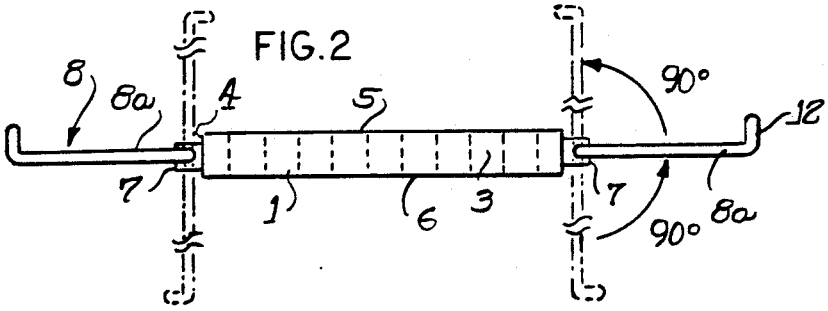
FIG.4
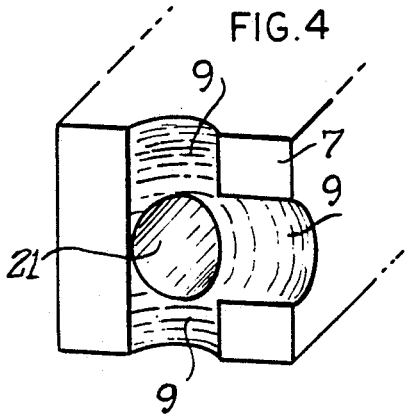
FIG.5
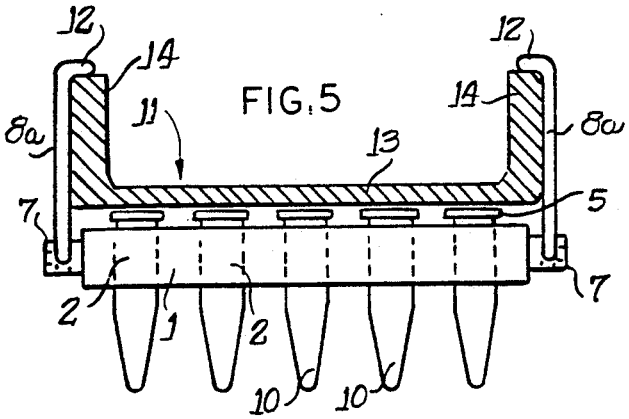
FIG.6
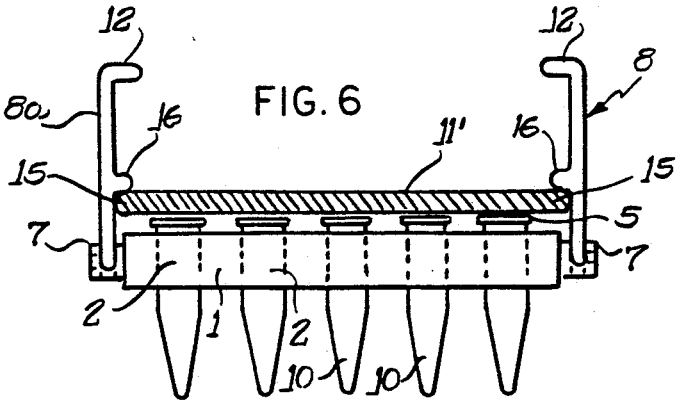

FLOATABLE LABORATORY TUBE HOLDER

FIELD OF THE INVENTION

The present invention relates to laboratory tube holders. More particularly, the invention concerns laboratory tube, particularly centrifuge tube holders that float on the surface of water and have handles which facilitate their manipulation.

The holders may also incorporate an insert which prevents the lids of the tubes from opening.

BACKGROUND OF THE INVENTION

Centrifuge tubes of various sizes are used in large quantities in chemical and microbiological laboratories. "Microfuge tubes" or "Eppendorf tubes" are predominantly manufactured in 0.5-ml and 1.5-ml sizes, and are usually equipped with polyethylene caps. Many of the manipulations that require the use of microfuge tubes are performed in water baths or on heating blocks. Often on boiling, the caps on the tubes pop open and the contents are forced out of the tubes, resulting in the loss of valuable samples. Various racks that hold centrifuge tubes, and particularly microfuge tubes, are commercially available, but most of the commercial products have no means for the prevention of the opening of polyethylene caps due to pressure caused by high heat. Moreover, there is no holder for microfuge tubes that could go directly from a heating block to a water bath and then to a bench. Due to these inconveniences and the usually high price of the commercial racks, scientists often make styrofoam "floatees" of their own. They usually punch holes the size of microfuge tubes, using a cork-borer, in a thin piece of styrofoam. The tubes, held firmly, float on top of the boiling water bath [Blumberg *Methods in Enzymology* 152 3 (1987)]. The homemade floatees are picked out of hot water baths with forceps and are transferred to heating blocks or to a bench. While these floatees are very inexpensive and convenient in that, since the whole rack floats, one does not need to adjust the level of water in the bath, valuable samples can be lost when the forceps used for manipulation slip, or when the microfuge tubes pop open due to high heat. The styrofoam floatees also tend to warp with exposure to high heat resulting in uneven heating/cooling of samples in different positions. There is a great need for centrifuge tube holders that are devoid of these disadvantages, can be directly transferred between heating blocks and water baths, have handles that facilitate manipulation, and have means for preventing the centrifuge tube caps from popping open.

U.S. Pat. No. 4,599,314 is directed to a specimen tray for holding a number of vessels which may be used in cell culture studies. Each vessel has an individual, removable cover. An overlying lid is adapted to cooperate with the specimen tray. The lid includes a plurality of openings that are co-incident with the openings on the tray. When the lid is in place, the top walls of the vessel covers project into the openings of the lid. A pressure sensitive tape can then be applied over the lid and the exposed surfaces of the covers, thereby releasably securing the covers to the lid. The tray has legs that are not pivotable, and has no handles. The pressure sensitive tapes employed for securing the vessel covers in place would not withstand low or elevated temperatures.

U.S. Pat. No. 1,653,244 relates to medicine trays used in hospitals. Pivotally connected to the tray interiorly of its ends are U-shaped handles which are movable from horizontal storage positions to upwardly extending carrying positions.

U.S. Pat. No. 4,609,237 discloses a food storage container having handles that are pivotable between horizontal and vertical positions. Detent means are provided for maintaining the handles in the desired position.

Floatable centrifuge tube holders that overcome the disadvantages of the foregoing are desired.

SUMMARY OF THE INVENTION

We have developed laboratory tube holders, particularly suited for centrifuge tubes, having handles that can be rotated through about 180 degrees, in about 90 degree increments. In their lower position, the handles serve as legs and are slightly longer than the portion of the tubes that extends downwardly from the block holding the tubes. In their upper position, the handles facilitate taking the centrifuge tube holder out of a water bath, or a heating block, and function to secure an insert over the tubes which prevents the lids of the tubes from opening.

More particularly, the present invention relates to a floatable laboratory tube holder, comprising a block of material of a density lighter than water defined by a base plane, a top plane and oppositely positioned pairs of side walls and end walls, and having a plurality of apertures for receiving laboratory tubes, each tube having a sealable lid;

a pair of end members connected with the oppositely positioned side walls or end walls of the block, for rotation in about 90 degree increments from a substantially vertical lower position wherein the end members extend below the base plane of the block, through a substantially horizontal intermediate position to a substantially vertical upper position wherein the end members extend above the top plane of the block. Preferably, an insert for overlying the laboratory tube lids is secured in place when the end members are rotated to the upper position.

The end members are longer than the portion of the tubes extending below the base plane of the tube holding block and are adapted to cooperate with the insert so that when the end members are in upper position, the insert is secured above the lids of the tubes, whereby they are prevented from opening.

The base member preferably includes an apertured block of material of a density so as to float on top of water and a pair of support members secured to oppositely positioned side walls or end walls of the apertured block for holding the end members.

The support members usually comprise position detent means for maintaining the end members in lower, intermediate, or upper position. The position detent means can be three indentations in the support members arranged in about 90 degree angles relative to each other.

According to one embodiment, the end members have a pair of parallel legs that terminate in finger-grippable cross members which serve as handles. They are rotatably attached to the support members by stub shafts formed on the opposite ends that extend inwardly and are received in holes in the support members.

The insert may be an U-shaped block of material of a density such as to not to submerge the floating base member.

BRIEF DESCRIPTION OF THE DRAWINGS

FIG. 1 is a top view of a centrifuge tube holder with the end members in lower position.

FIG. 2 is a front view of a centrifuge tube holder illustrating the three possible positions of the end members.

FIG. 3 is a perspective view of a centrifuge tube holder with the end members in lower position.

FIG. 4 is a perspective view of a support member attached to a centrifuge tube holding block (not shown). The three indentations arranged in 90 angles relative to each other are shown.

FIG. 5 is a front view of an embodiment of a centrifuge tube holder with the end members in upper position and with an U-shaped lid secured in place.

FIG. 6 is a front view of a further embodiment of a centrifuge tube holder with the end members in upper position and with a flat insert secured in place.

DETAILED DESCRIPTION OF THE INVENTION

A specific embodiment of a centrifuge tube holder of the present invention is illustrated in FIGS. 1 to 5.

A block 1 formed of material having a density such that it will float on top of water contains openings 2 for receiving centrifuge tubes. The block is defined by two oppositely positioned side walls 3 and end walls 4, a top plane 5 (e.g. as shown in FIGS. 1 to 3) and a base plane 6 (FIGS. 2 and 3).

Attached to or formed as a portion of the oppositely positioned end walls 4 of the block 1, there are two support members 7, to which the end members 8 are connected. Formed in lateral surfaces of the support members 7 are three indentations 9 arranged in about 90 degree angles relative to each other. The end members 8 have finger-grippable cross members 12 that serve as the handles that interconnect the ends of parallel arms 8*a* which can be rotated about 180 degrees between essentially vertical lower and upper positions through an essentially horizontal intermediate position as a result of stub shafts which are bent inward perpendicular to the arms at the opposite ends thereof, and which are received in cooperating holes 21 in the support members. When in lower position, the end members 8 serve as legs. When the holder is placed on a horizontal surface, e.g. on a bench, the legs are just longer than the centrifuge tubes 10 received in the openings 2 of the centrifuge tube holder block 1. In their vertical upper position, the end members 8 serve as handles to facilitate the removal of the centrifuge tube holder out of a heating block or water bath. The end members 8 can also snap into a horizontal intermediate position, for possible storage in a shallow drawer.

For use in boiling water baths, the centrifuge tube holder is provided with an insert 11 shown in FIG. 5. The insert is locked in position over and preferably in contact with the lids of the centrifuge tubes by means of inwardly extending portions 12 of the end members 8 being in upper position. As illustrated in FIG. 5, the insert 11 may be a U-shaped block of material of a density that will not submerge the floating base member, comprising a base section 13 and two side sections 14.

Alternatively, as illustrated in FIG. 6, the insert 11 may be flat and of suitable thickness so that the opposite end edges 15 will be engaged and locked in place by a pair of retainers 16 affixed to the inward facing surfaces or edges of the end members 12 when they are in the upright position.

The centrifuge tube holder of the present invention is preferably designed to match the hole pattern in a heating block. In a typical heating block there are twenty spaces for 1.5 ml microfuge tubes, arranged in four rows of five spaces each. For 0.5 ml microfuge tubes, a typical heating block has thirty spaces, arranged in five rows of six spaces each. Accordingly, the centrifuge tube holder of the present invention is preferably designed to hold up to twenty 1.5 ml microfuge tubes, or up to thirty 0.5 ml microfuge tubes arranged in the same pattern. The centrifuge tube holder can be directly moved from a heating block to a water bath or to a bench. In a water bath, the centrifuge tube holder suspends the centrifuge tubes at water level.

The present centrifuge tube holder is preferably made of a low density, heat-resistant material that is stable in the temperature range of about −70° C. and 100° C. More particularly, the material should be able to float on the surface of water, should not warp when exposed to high temperatures of about 100° C., and should not become fragile and brittle at low temperatures (freezer storage at about −70° C.). Typical examples of suitable materials include polymethylpentene sold under the trademark TPX® by Mitsui Petrochemical Industries, polypropylene and polyurethane. They may be in foam form so as to have a density less than that of water or may be molded in the form of a firm hollow outer skin that is filled with foam made of a different plastic material, for a more bend-resistant body.

The end members 8 serve either as legs or as handles, depending on their position, and are conveniently bent from metal wire of round cross section. The metal must be able to keep its shape and have sufficient resiliency to spring back and firmly engage the support members at the 90 degree indentations. Alternatively, the end members may be molded of a harder plastic material.

It should be understood that while the present invention is illustrated by reference to preferred embodiments, modifications and alterations can be made by those of ordinary skill in the art without departing from the spirit and scope of the invention as defined by the following claims. Although the illustrated embodiments relate to centrifuge (microfuge) tube holders, similar holders are suitable for the storage of other tubes, for example cryogenic vials with screw cap tops, which fit into microfuge tube racks. The term "laboratory tube" and grammatical variations thereof as used herein, include all of these and similar equivalents used in chemical or biological laboratories.

Particular features of the invention are emphasized in the claims which follow.

We claim:

1. A floatable laboratory tube holder, comprising:

(a) a block of material of a density floatable in water, having a base planar surface, a top planar surface, a pair of oppositely positioned side walls, a pair of oppositely positioned end walls, and having means defining a plurality of openings extending through both said top and base planar surfaces of said block for receiving laboratory tubes;

(b) a pair of end members for supporting said block rotatably attached to opposing ends of said block wherein said end members may extend in a 180 degree rotation around the plane of said block;

said pair of end members each comprising two parallel arms, each arm being rotatably connected to said block at one end and said pair of parallel arms being interconnected by a cross arm at the ends opposite from which they are rotatably connected;

(c) a pair of oppositely positioned support members secured to, and extending partially along, said pair of end walls, or said pair of side walls of said block, said pair of support members each having a position detent means comprising three indentations on opposite ends of each support member arranged in 90 degree angles relative to one another for receiving and retaining said pair of end members in an orientation either 90 degrees above the plane of said block, coplanar with said block, or 90 degrees below the plane of said block; and (d) an insert which is proportioned to be positioned along said top planar surface of said block of said holder between said pair of end members extended 90 degrees above the plane of said block.

2. A floatable laboratory tube holder according to claim 1 wherein said block and said insert are made of a heat-resistant material that is stable at temperatures of 100 degrees C or higher.

3. A floatable laboratory tube holder according to claim 2 wherein said heat-resistant material is polymethylpentene, polypropylene or polyurethane foam.

4. A floatable laboratory tube holder according to claim 1 wherein each of said pair of end members are bent metal rods of circular cross section.

5. A floatable laboratory tube holder, comprising:

(a) a block of material of a density floatable in water, having a base planar surface, a top planar surface, a pair of oppositely positioned side walls, a pair of oppositely positioned end walls, and having means defining a plurality of openings extending through both said top and base planar surfaces of said block for receiving laboratory tubes;

(b) a pair of end members for supporting said block rotatably attached to opposing ends of said block wherein said end members may extend in a 180 degree rotation around the plane of said block, 90 degrees above the plane of said block, coplanar with said block, and 90 degrees below the plane of said block;

said pair of end members each comprising two parallel arms, each arm being rotatably connected to said block at one end, said pair of parallel arms being interconnected by a cross arm at the ends opposite from which they are rotatably connected, said parallel arms and said cross arms of each of said pair of members being metal rods having a circular cross section; and (c) a U-shaped floatable insert having a base and two upstanding sides, said base being proportioned to be positioned along said top planar surface of said block of said holder.

6. A floatable laboratory tube holder according to claim 5 wherein said pair of cross members extends inwardly from a respective one of said pair of end members when said pair of end members extends 90 degrees above the plane of said block, to cooperate with said upstanding sides of said insert and secure said insert in place.

7. A floatable laboratory tube holder, comprising:

(a) a block of material of a density floatable in water, having a base planar surface, a top planar surface, a pair of oppositely positioned side walls, a pair of oppositely positioned end walls, and having means defining a plurality of openings for receiving laboratory tubes extending through both the top and base planar surfaces of said block;

(b) a pair of end members for supporting said block rotatably attached to opposing ends of said block wherein said pair of members may extend in a 180 degree rotation from an orientation above the plane of said block to an orientation therebelow, said pair of end members each comprising a pair of parallel arms, each arm being rotatably connected to said block at one end, said pair of parallel arms being interconnected by a cross arm at the ends opposite from which they are rotatably connected;

(c) a pair of oppositely positioned support members extending partially along either said pair of end walls, or said pair of side walls, of said block, said pair of support members having means for rotatably attaching and retaining said end members so that the end members may be rotated to positions at 90 degrees above the plane of said block; coplanar with said block; and at 90 degrees below the plane of said block; and (d) said pair of support members having a position detent means comprising three indentations on opposite ends of each support member arranged in 90 degree angles relative to each other for receiving and retaining said end members in set positions of 90 degree angles relative to one another.

8. A floatable laboratory tube holder according to claim 7 wherein each said cross arm of said pair of end members is offset at both ends from the plane of said parallel arms adjacent its points of joinder with said pair of parallel arms of said ends members.

9. A floatable laboratory tube holder, comprising:

(a) a block of material of a density floatable in water, having a base planar surface, a top planar surface, a pair of oppositely positioned side walls, a pair of oppositely positioned end walls, and having means defining a plurality of openings for receiving laboratory tubes extending through both the top and base planar surfaces of said block;

(b) a pair of end members for supporting said block rotatably attached to opposing ends of said block wherein said pair of members may extend in a 180 degree rotation from an orientation above the plane of said block to an orientation therebelow, said pair of end members each comprising a pair of parallel arms, each arm being rotatably connected to said block at one end, said pair of parallel arms being interconnected by a cross arm at the ends opposite from which they are rotatably connected;

(c) a pair of oppositely positioned support members extending partially along either said pair of end walls, or said pair of side walls, of said block, said pair of support members having means for rotatably attaching and retaining said end members so that the end members may be rotated to positions at 90 degrees above the plane of said block; coplanar with said block; and at 90 degrees below the plane of said block;

(d) a removable U-shaped insert of floatable material comprising a base and two upstanding sides, wherein said base is proportioned to be positioned along said top planar surface of said block of said holder between said pair of end members when extended 90 degrees above said block; and (e) said pair of end members including means to retain said U-shaped insert in place atop said planar surface.

* * * * *